United States Patent [19]

Maisch et al.

[11] 4,381,751

[45] May 3, 1983

[54] FUEL INJECTION SYSTEM

[75] Inventors: Wolfgang Maisch, Schwieberdingen; Jürgen Peters, Affalterbach; Michael Wissmann, Gerlingen; Karl Gmelin, Ingelfingen; Peter Stiefel, Ditzingen, all of Fed. Rep. of Germany

[73] Assignee: Robert Bosch GmbH, Stuttgart, Fed. Rep. of Germany

[21] Appl. No.: 236,382

[22] Filed: Feb. 20, 1981

[30] Foreign Application Priority Data

Feb. 22, 1980 [DE] Fed. Rep. of Germany ..... 3006586

[51] Int. Cl.[3] ..... F02M 39/00

[52] U.S. Cl. ..... 123/454

[58] Field of Search ..... 123/452, 453, 454

[56] References Cited

U.S. PATENT DOCUMENTS

| | | | |
|---|---|---|---|
| 3,809,036 | 5/1974 | Knapp et al. | 123/452 X |
| 3,981,288 | 9/1976 | Wessel | 123/454 X |
| 3,994,273 | 11/1976 | Stumpp | 123/454 |
| 4,075,995 | 2/1978 | Kramer | 123/452 |
| 4,220,129 | 9/1980 | Steinwart et al. | 123/452 X |

*Primary Examiner*—Tony M. Argenbright
*Attorney, Agent, or Firm*—Edwin E. Greigg

[57] ABSTRACT

A fuel injection system is proposed which serves to provide the most precise possible adaptation of the fuel-air mixture to operating conditions of the internal combustion engine. The fuel injection system includes metering valves, each of which is assigned one regulating valve, whose movable valve element can be exposed on the one hand to the fuel pressure downstream of the respective metering valve and on the other hand to the pressure in a control pressure line, which is limited on the one hand by an electro-fluid converter of the nozzle/bounce plate type and on the other hand by a control throttle. The electro-fluid converter is triggerable in accordance with operating characteristics of the engine. A pressure limitation valve is embodied as a diaphragm valve and serves to regulate the most precise possible system pressure in the engine and, when the engine is shut off, it serves to reduce the fuel pressure in the fuel injection system below the fuel pressure required for opening the injection valves and to block the return flow lines.

12 Claims, 2 Drawing Figures

FUEL INJECTION SYSTEM

BACKGROUND OF THE INVENTION

The invention is based on a fuel injection system for an internal-combustion engine having externally-supplied ignition including metering valves disposed in a fuel supply line for metering a quantity of fuel in a predetermined ratio to the quantity of air aspirated by the engine, and a regulating valve having a movable element disposed downstream of each metering valve for regulating pressure differences at each metering valve. A fuel injection system is already known in which, in order to control the fuel-air mixture in accordance with operating characteristics of the internal combustion engines, the pressure difference at metering valves is variable as a result of the exertion of the pressure of a pressure fluid in a control pressure line upon regulating valves, where an electromagnetic valve triggerable in accordance with operating characteristics of the internal combustion engine is disposed in this control pressure line. The control pressure line communicates via a throttle with the fuel supply line of the fuel injection system in which a pressure limitation valve is disposed for the purpose of regulating the fuel pressure. The pressure of the fuel in the fuel supply line is exerted upon the control slide of the metering valve, via an additional line, and thus exerts a restoring force. Very stringent demands are made of this pressure limitation valve, because fluctuations in the fuel pressure in the fuel supply line not only cause an undesirable variation of the restoring force upon the control slide of the metering valve, but they also have an effect in the control pressure line, causing errors in fuel metering.

OBJECTS AND SUMMARY OF THE INVENTION

The fuel injection system according to the invention and having the characteristics of the main claim has the advantage over the prior art that changes in the fuel pressure and the fuel supply line are compensated for by means of differential pressure regulation in the control pressure line, and the fuel metering is thus not impaired.

As a result of the characteristics disclosed in the dependent claims, advantageous modifications of and improvements to the fuel injection system disclosed in the main claim are attainable.

It is particularly advantageous to embody the pressure limitation valve as a very precisely regulating diaphragm valve, which upon shutoff of the engine first causes a reduction of the fuel pressure in the fuel injection system below the opening pressure of the injection valves, and thereafter, by its closing, effects a seal of the return flow line, while a higher fuel pressure is required for opening, thus assuring reliable pressure maintenance in the shutoff phase.

The invention will be better understood and further objects and advantages thereof will become more apparent from the ensuing detailed description of a preferred embodiment taken in conjunction with the drawing.

DESCRIPTION OF THE PREFERRED EMBODIMENT

Figures 1, 2:
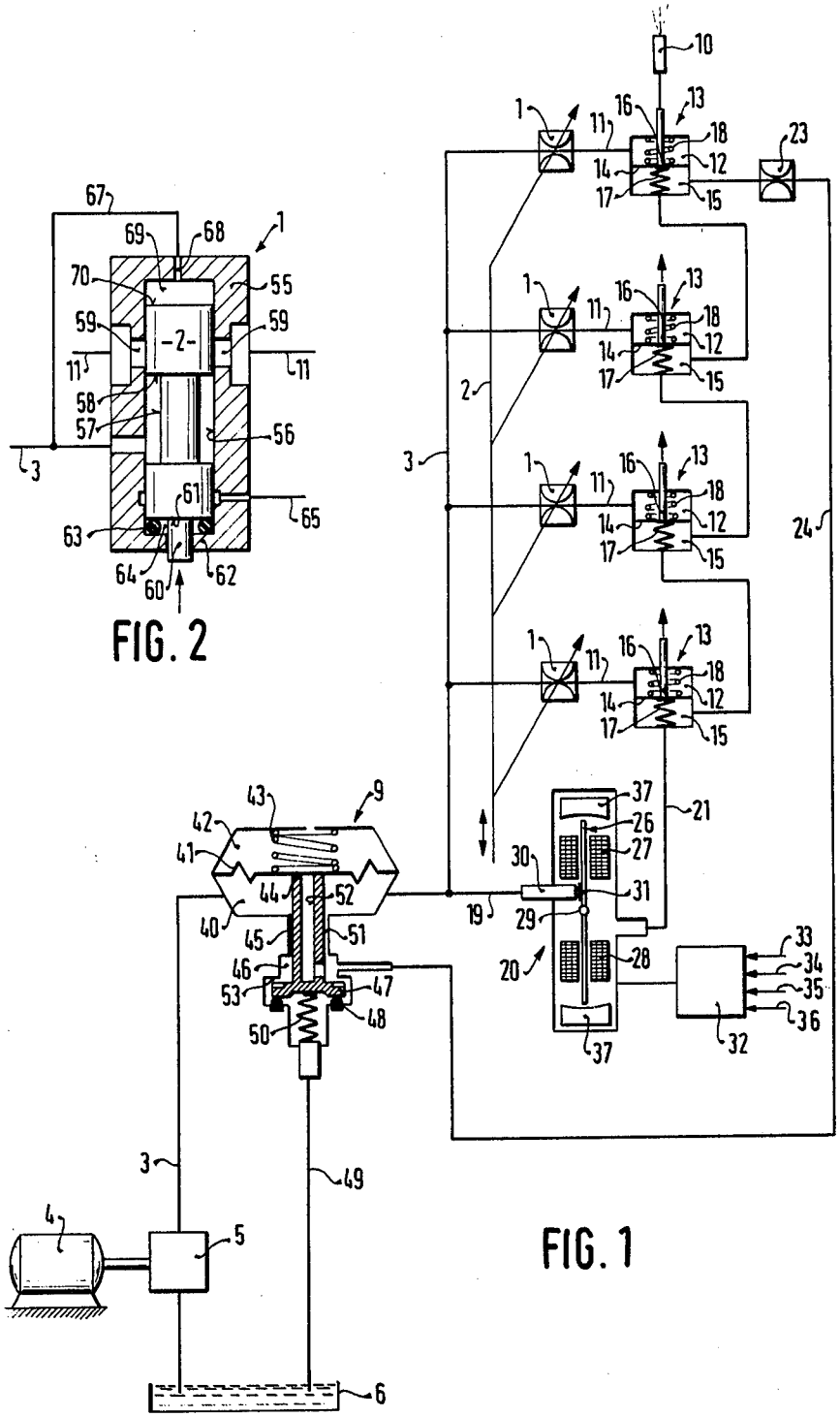
FIG. 1 shows a fuel injection system according to the invention.
FIG. 2 is a detailed representation of a fuel metering valve.

In the exemplary embodiment shown in FIG. 1 of a fuel injection system, metering valves 1 are shown, with one metering valve 1 associated with each cylinder of a mixture-compressing internal combustion engine with externally-supplied ignition, not shown. At these metering valves 1, a quantity of fuel is metered which is in a predetermined ratio to the quantity of air aspirated by the engine. The fuel injection system shown has, by way of example, four metering valves 1 and is thus intended for a four-cylinder engine. The cross section of the metering valves is variable in common, as shown by way of example in the drawing, by means of an actuation element 2 in accordance with operating characteristics of the engine; this variation may, for instance, be made in a known manner in accordance with the quantity of air aspirated by the engine. The metering valves 1 are located in a fuel supply line 3, into which fuel is supplied from a fuel container 6 by a fuel pump 5 driven by an electromotor 4. A pressure limitation valve 9 is disposed in the fuel supply line 3 and limits the fuel pressure prevailing in the fuel supply line 3, permitting the fuel to flow back into the fuel container 6 if this fuel pressure exceeds a desired value.

Downstream of each metering valve 1, a line 11 is provided by way of which the metered fuel proceeds into a regulating chamber 12 of a regulating valve 13, one of which is assigned to each metering valve 1. A regulating chamber 12 of the regulating valve 13 is separated by a movable valve element, embodied by way of example as a diaphragm 14, from a control chamber 15 of the regulating valve 13. The diaphragm 14 of the regulating valve 13 cooperates with a fixed valve seat 16 provided in the regulating chamber 12, by way of which valve seat 16 the metered fuel can flow out of the regulating chamber 12 to the individual injection valves 10, of which only one is shown in the intake tube of the engine. A differential pressure spring 18 is disposed in the regulating chamber 12, which urges the diaphragm 14 in the opening direction of the regulating valve 13. A closing spring 17 is also disposed in the control chamber 15, its spring force being greater than that of the differential pressure spring 18, so that when the engine is shut off the diaphragm 14 is held at the valve seat 16, and when the engine is started the diaphragm 14 thus does not move toward the valve seat 16.

A line 19 branches off from the fuel supply line 3, discharging into a control pressure line 21 by way of an electro-fluid converter of the nozzle/bounce plate type 20. The control chambers 15 of the regulating valve 13 are disposed in the control pressure line 21 downstream of the electro-fluid converter 20, and a control throttle 23 is disposed downstream of the control chambers 15. Fuel can flow out of the control pressure line 21 into a discharge line 24 by way of the control throttle 23. The electro-fluid converter of the nozzle/bounce plate type is known per se and will accordingly be described herein only briefly as to its function and mode of operation.

The electro-fluid converter 20 contains a rocker 26, to which a variable deflection moment is imparted electromagnetically by means of coils 27, 28 so that it undergoes a certain deflection about a rotary axis 29. The line 19 discharges by means of a nozzle 30 in the electro-fluid converter 20, opposite a bounce plate 31 attached to the rocker 26. At a constant deflection moment engaging the rocker 26, a pressure drop is thus created between the nozzle 30 and the bounce plate 31, this drop being large enough so that a constant pressure difference, dependent on the deflection moment, is established by the fuel pressure in the line 19 and the fuel pressure in the control pressure line 21. The electro-fluid converter 20 is triggered by way of an electronic control device 32 in accordance with appropriately furnished operating characteristics of the engine, such as rpm 33, throttle valve position 34, temperature 35, exhaust composition (oxygen sensor) 36 and others. The electro-fluid converter 20 may be triggered by the electronic control device 32 in either analog or clocked fashion. In the non-excited state of the electro-fluid converter 20, a fundamental moment can be brought about on the rocker 26 by means of suitable spring forces or permanent magnets 37, this fundamental moment being diminished such that a pressure difference is established which assures emergency operation of the engine even in the case of failure of the electrical triggering process.

In the presence of control signals characterizing engine overrunning, such as rpm above the idling rpm and a closed throttle valve, the electro-fluid converter 20 can be excited in such a manner that the fuel pressure in the control pressure line 20 increases to such an extent that the regulating valves 13 close, thus precluding any injection of fuel via the injection valve 10.

The pressure limitation valve 9 has a system pressure chamber 40, which communicates with the fuel supply line 3 and is separated by a valve diaphragm 41 from a spring chamber 42 which communicates with the atmosphere and in which a system pressure spring 43 is disposed which urges the valve diaphragm 41 in the closing direction of the valve. A valve seat 44 protrudes into the system pressure chamber 40, cooperating with the valve diaphragm 41 and being supported in an axially displaceable manner on an axial bearing point 45. The end of the valve seat remote from the valve diaphragm 41 protrudes at the other end out of an axial bearing point 45 into a collection chamber 46 and is embodied as a valve plate 47. The valve plate 47 opens or closes a sealing seat 48, which may be embodied as a rubber ring, by way of which fuel can flow back into a return flow line 49 and from there toward the intake side of the fuel pump 5, for instance toward the fuel container 6. A closing pressure spring 50 is supported on the valve plate 47 and urges the valve plate 47 in the opening direction, having the tendency to displace the valve seat 44 counter to the force exerted upon the valve seat 44 by way of the valve diaphragm 41. A throttle gap 51 is provided in the axial bearing point 45 of the valve seat 44 between the system pressure chamber 40 and the collection chamber 46. All the fuel lines, for instance the discharge line 24 by way of which the fuel is intended to flow back to the fuel container 6, discharge into the collection chamber 46. Thus a conduit 52 is provided in the valve seat 44, by way of which fuel can flow into the collection chamber when the valve diaphragm 41 is raised up from the valve seat 44. The cross section of the valve plate 47 exposed to fuel has a smaller diaphragm cross section 41, and the elastic sealing seat 48 has approximately the same cross section as does the valve plate 47.

The function of the pressure limitation valve 9 is as follows:

When the engine is being shut off, the valve plate 47 seats itself on the sealing seat 48 and closes the fuel return flow line 49, while the valve diaphragm 41 closes the valve seat 44. When the engine is started, the fuel pump 5 supplies fuel into the fuel supply line 3 and thus into the system pressure chamber 40 of the pressure limitation valve 9 as well. If this pressure increases above a predetermined opening pressure at which the force of the fuel pressure exerted upon the valve diaphragm 41 and the spring force of the closing pressure spring 50 are larger than the spring force of the system pressure spring 43 and the force of the fuel pressure exerted on the valve plate 47, then the valve plate 47 lifts up from the sealing seat 48, and the valve seat 44 is displaced in the direction of the valve diaphragm 41. This displacement is limited by a stop 53, at which point the valve plate 47 comes to rest. Now, if a fuel pressure (system pressure) determined only by the spring force of the system pressure 43 is attained, then the valve diaphragm 41 lifts up from the valve seat 44 and fuel can flow via the conduit 52 into the collection chamber 46 and from there into the return flow line 49. As the engine is being shut off, the fuel supply on the part of the fuel pump 5 is interrupted and the valve diaphragm 41 closes the valve seat 44. The spring forces of the system pressure spring 43 and the closing pressure spring 50 and the cross section of the valve diaphragm 41 as well as that of the valve plate 47 exposed to fuel are adapted to one another in such a way that at first fuel can continue to flow by way of the throttle gap 51 into the collection chamber 46 and out of the collection chamber 46 by way of the sealing seat 48 into the return flow line 49, until the fuel pressure in the fuel injection system is lower than the fuel pressure required for opening the injection valves 10. The valve plate 47 is displaced to such an extent, counter to the force of the closing pressure spring 50, that it comes to rest on the sealing seat 48, closing the return flow line 49, only when the fuel pressure is below that required to open the injection valves 10. The valve plate 47 is additionally pressed against the sealing seat 48 by the fuel pressure prevailing in the collection chamber 46. As a result, leakage of fuel out of the fuel injection system is prevented, so that when the engine is started once again the fuel injection system is operational in the shortest possible time. Now if the engine is started once again, then the required opening pressure, at which the valve plate 47 lifts up from the sealing seat 48, is greater than the pressure required for closing, because in the closed state there is no equalization of forces at the valve plate 47 between the pressure forces brought about in the collection chamber 46 by the fuel pressure. However, it is desirable to increase the opening pressure relative to the closing pressure, in order to assure reliable closing despite the fact that the fuel pressure in the fuel injection system does increase after the engine has been shut off as a result of the warming of the fuel enclosed in the system which still takes place even after the engine has shut off.

In FIG. 2, a metering valve 1 of the type revealed herein is shown in more detail, wherein a metering sheath or housing 55 in which a control slide 2, acting as an actuation element, is supported in an axially displaceable manner in a slide bore 56. The control slide 2 has a control groove or reduced area 57 which is defined on one side by a control edge 58. When there is a displacement movement upward, the control edge 58 to a greater or lesser extent opens control ports 59, which may be control slits by way of example, by way of which the fuel can flow in metered fashion into the lines 11. The actuation side of the control slide 2, at one actuation end 60, may be engaged in a known manner, for instance, by an air flow rate meter, not shown, thereby displacing the control slide 2 in accordance with the quantity of air aspirated by the engine. At the transition to the actuation end 60 which has a smaller cross section, a step 61 is formed. The actuation end 60 is encompassed by a radial wall 62 and thus closes off the slide bore 56 at the bottom. An elastic sealing ring 63 is disposed on the radial wall 62, and the step 61 is arranged to rest on this elastic sealing ring 63 in the rest or neutral position of the control slide 2, thus sealing this area from the outside. In the working position of the control slide 2, a leakage chamber 64 is formed between the step 61 and the radial wall 62, this leakage chamber 64 intercepting the fuel leaking out of the control groove 57 by way of the outer circumference of the control slide 2, and a leakage line 65 leads from there to the collection chamber 46 of the pressure limitation valve 9. The force counteracting the actuation force exerted upon the actuation end 60 is exerted by fuel. To this end, a line 67 branches off from the fuel supply line 3 and discharges via a damping throttle 68 into a pressure chamber 69, into which one end face 70 remote from the actuation end 60 of the control slide 2 protrudes.

The foregoing relates to a preferred exemplary embodiment of the invention, it being understood that other embodiments and variants thereof are possible within the spirit and scope of the invention, the latter being defined by the appended claims.

What is claimed and desired to be secured by letters patent of the United States is:

1. A fuel injection system for mixture-compressing internal combustion engines having externally-supplied ignition, said system further including metering valves disposed in a fuel supply line for metering a quantity of fuel in a predetermined ratio to the quantity of air aspirated by the engine, said metering being effected at a constant pressure difference variable in accordance with operating characteristics of said engine, said system further including a regulating valve having a movable valve element disposed downstream of each metering valve and arranged to regulate pressure differences at each metering valve, said regulating valve further arranged to be exposed on the one hand to fuel pressure downstream of the respective metering valve and on the other hand to the pressure in a control pressure line, the pressure in said line being further limited on the one hand by a control pressure valve and on the other hand by a control throttle, characterized in that an electro-fluid converter means of the nozzle/bounce plate type serves as said control pressure valve and is triggerable by an electronic control device in accordance with engine characteristics, said electro-fluid converter means dividing said control pressure line from said fuel supply line, and said control throttle limiting the pressure in said control pressure line downstream of said regulating valves.

2. A fuel injection system as defined by claim 1, characterized in that in said electro-fluid converter means includes a bounce plate, and has a non-excited state wherein said bounce plate is held in a position in which a control pressure is established in said control pressure line which assures emergency operation of said engine.

3. A fuel injection system as defined by claim 1, characterized in that said regulating valve further includes a regulating chamber and a control chamber separated by said movable valve element each of said chambers provided with spring means, said regulating chamber arranged to receive fuel downstream of said metering valve and further that said control chamber communicates with said control pressure line downstream of said electro-fluid converter means.

4. A fuel injection system as defined by claim 3, characterized in that said electro-fluid converter means is excitable under the influence of control signals characterizing engine overrunning, whereby the regulating valves close.

5. A fuel injection system as defined by claim 1, characterized in that said fuel supply line further includes a pressure limitation valve disposed in said fuel supply line upstream of said fuel metering valves and the electro-fluid converter means, said pressure limitation valve further including a valve seat and a valve diaphragm, the latter being exposed on the one hand to atmospheric pressure and a system pressure spring and on the other hand to a fuel pressure in said fuel supply line prevailing in an adjacent system pressure chamber and to a closing pressure spring, said spring arranged to engage one end means of said valve seat remote from said valve diaphragm, to urge said valve seat in the direction of said valve diaphragm, the other end of said valve seat protruding into said system pressure chamber, whereupon when the pressure limitation valve is opened fuel can flow out via a conduit of said valve seat into a collection chamber, which is separated from said system pressure by an axial bearing point of said valve seat and into which collection chamber said end of said valve seat remote from the valve diaphragm protrudes, said end being embodied as a valve plate and arranged to open or close a sealing seat which leads to a return flow line and can be pressed against a stop, on the other hand, by said closing pressure spring upon the attainment of a predetermined fuel pressure in the system pressure chamber.

6. A fuel injection system as defined by claim 5, characterized in that said axial bearing point of said valve seat is provided with a throttle gap between said system pressure chamber and said collection chamber.

7. A fuel injection system as defined by claim 6, characterized in that said valve plate has a cross section which is exposed to fuel said cross section of said valve plate being smaller than a cross section of said valve diaphragm.

8. A fuel injection system as defined by claim 7, characterized in that said sealing seat comprises an elastic ring.

9. A fuel injection system as defined by claim 7, characterized in that said spring forces of said system pressure spring and said closing pressure spring and the cross sections of the valve diaphragm as well as said valve plate all of which are exposed to fuel are adapted to one another so that said valve plate comes to rest at said sealing seat, thus closing the return flow line when the fuel pressure in the fuel injection system is lower than the fuel pressure required for opening said injection valves.

10. A fuel injection system as defined by claim 9, characterized in that all fuel flows back to said fuel container via said collection chamber.

11. A fuel injection system as defined by claim 10, characterized in that said metering valve has a control slide axially displaceable within a metering sheath, said control slide having a control edge defining a control groove on one side, said groove arranged to open metering ports to a greater or less extent, said control slide further having an actuation end in proximity to a step, said actuation end having a smaller cross section and said step being pressed against a sealing ring which is supported on a radial wall of said metering sheath.

12. A fuel injection system as defined by claim 11, characterized in that said radial wall of said metering sheath further includes a leakage chamber which leads to said collection chamber via a leakage line.

* * * * *